United States Patent [19]

Pease

[11] Patent Number: 4,665,356

[45] Date of Patent: May 12, 1987

[54] INTEGRATED CIRCUIT TRIMMING

[75] Inventor: Robert A. Pease, San Francisco, Calif.

[73] Assignee: National Semiconductor Corporation, Santa Clara, Calif.

[21] Appl. No.: 822,577

[22] Filed: Jan. 27, 1986

[51] Int. Cl.[4] ..... G05F 3.22

[52] U.S. Cl. ..... 323/314; 323/354; 323/907

[58] Field of Search ..... 323/312, 313, 314, 315, 323/316, 349–350, 354, 907

[56] References Cited

U.S. PATENT DOCUMENTS 4,087,758 5/1978 Hareyama ..... 323/314

4,100,437 7/1978 Hoff, Jr. ..... 323/314 X 4,225,878 9/1980 Dobkin ..... 357/45 X 4,412,241 10/1983 Nelson ..... 323/354 X 4,550,262 10/1985 Kohsiek ..... 323/316 X

*Primary Examiner*—Peter S. Wong

*Attorney, Agent, or Firm*—Gail W. Woodward

[57] ABSTRACT

A circuit is described for trimming a monolithic PN junction isolated silicon IC. The value of a moderate value resistance network is translated to a current that can be made to have a predetermined temperature coefficient and can be applied to the IC. A voltage regulator is shown in which the output voltage and the temperature coefficient can be independently adjusted both at wafer sort and after assembly.

17 Claims, 9 Drawing Figures

Δ = DENOTES LASER TRIMMABLE

INTEGRATED CIRCUIT TRIMMING

BACKGROUND OF THE INVENTION

Integrated circuit (IC) trimming involves the changing of a circuit component value to create a desired performance function. Usually the value of a resistance element is adjusted either step-wise or continuously. In the continuous adjustment a resistor is abraded, such as by means of an abrasive blast, or otherwise removed in part, such as by means of a vaporizing laser beam, to raise its resistance to a desired value. The parameter being adjusted is often monitored during the adjustment which can then be halted when the desired value is achieved. In the step-wise adjustment the step values are ordinarily previously known and often are fabricated to create a digitally related set of values. The parameter to be adjusted is first measured and the desired step determined. Then the desired step is achieved by whatever means is being employed. In some cases each resistor in a series string is shunted by a zener diode. When such a diode is subjected to a burnout pulse, in a process called zapping, it reverts to a short thereby shorting out the associated resistor.

U.S. Pat. No. 4,225,878, issued to Robert C. Dobkin on Sept. 30, 1980, and is assigned to the assignee of the present invention. This patent relates to zener diode zapping wherein the required number of IC bonding pads is reduced in number by employing a polarity-sensitive zapping procedure.

U.S. Pat. No. 4,412,241, issued to Carl T. Nelson on Oct. 25, 1983 and is also assigned to the assignee of the present invention. In this invention a combination of zener zapping and fuse blowing is employed to provide a plurality of resistance values. In a typical example, a pair of IC bonding pads is employed to either increase or decrease a nominal resistance to achieve any one of five discrete resistance values. If desired, the five discrete resistance values can be made to have substantially equal steps.

The teaching in the above two patents is incorporated herein by reference.

When trimming is to be applied to a voltage regulator or voltage reference supply, one trim is employed to achieve a particular voltage level. A second trim is then employed to adjust the temperature coefficient (tempco) of voltage. In typical prior art devices these two trims interact so that the adjustment includes a first adjustment of each parameter and then a second adjustment of at least one parameter to achieve the desired result.

SUMMARY OF THE INVENTION

It is an object of the invention to provide an IC which will produce a current having a predetermined tempco and a magnitude determined by a trimmable resistor value.

It is a further object of the invention to employ a variable current in the trimming of a voltage regulator circuit to determine the output voltage and to provide a separate tempco adjustment.

It is a still further object of the invention to provide an IC voltage regulator which has a first trim that determines the voltage magnitude and a second noninteractive trim that determines tempco.

It is a still further object of the invention to provide an IC trimming arrangement that can be employed either at wafer trimming or after assembly or both.

These and other objects are achieved as follows. An IC is created wherein a pair of supply currents are passed through the collectors of a pair of transistors coupled in cascade and each transistor has a nominal value resistor (several thousand ohms) in series with its emitter. The second transistor has its collector returned to its base. The first transistor collector is coupled to drive a third high Beta output transistor, the emitter of which is returned to the emitter of the second transistor. In this configuration if the first two transistors are matched and the resistors of equal value, zero current will flow in the third transistor. If the resistor in the first transistor emitter is increased a current will flow in the third transistor in proportion to the resistor value. If desired the supply currents can be made proportional to absolute temperature (PTAT) so that the third transistor current is PTAT. Additionally, if desired, the third transistor, which ordinarily acts as a current sink, can be coupled to a current mirror, the output of which provides a current source.

DESCRIPTION OF THE PRIOR ART

Figure 1:
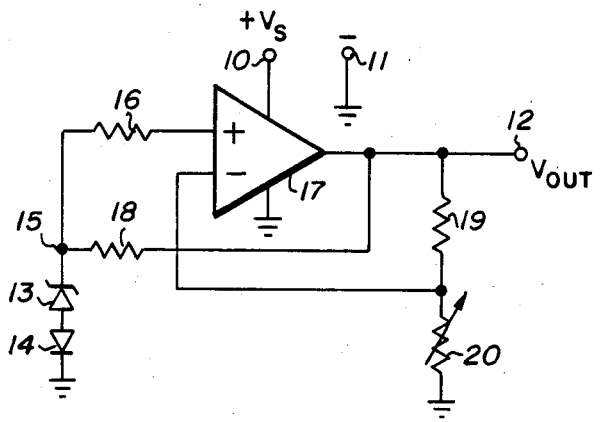
Fig. 1 (PRIOR ART)
FIG. 1 is a schematic diagram of a prior art adjustable voltage reference supply.

FIG. 1 is a schematic diagram of a basic reference voltage supply. A supply source $V_S$ is connected + to terminal 10 and − to ground terminal 11. A regulated output appears at terminal 12. The heart of the circuit is a zener diode 13 coupled in series with a forward biased diode 14. A forward biased diode has a tempco of about −2 mv/° C. The typical zener diode created from an NPN transistor emitter-base diode has a tempco of about +3 mv/° C. If the zener diode is more heavily doped to bring its zener voltage down it can be made to have a tempco of close to 2 mv/° C. When this is done the tempcos cancel and the combined voltages of the series combination is relatively constant with temperature. For this condition the potential at node 15 is close to 6.850 volts when using integrated circuit components. It is to be understood that the 6.850 volt condition relates to a particular set of IC components and conditions. It can vary to a slight degree with device processing and geometry. The important factor is that at a specific voltage the tempco is very low.

Resistor 16 couples node 15 to the noninverting input of Op Amp 17 which is a high gain device. Resistor 18 is coupled between node 15 and $V_{OUT}$ terminal 12 so as to provide the zener diode reverse bias. Resistors 19 and 20 form a voltage divider across at $V_{OUT}$ terminal 12 and act to provide an attenuated voltage to the inverting input of Op Amp 17. In operation Op Amp 17 will force output terminal 12 to that potential that will cause the inverting input voltage to match the noninverting input voltage. By making the voltage divider variable, as shown by variable resistor 20, the output voltage can be adjusted to any potential greater than the terminal 15 voltage. If this circuit is mass manufactured, the characteristics of the finished devices depend upon the character of the zener diode. When the combined diode voltages equal 6.850, the circuit will have close to zero tempco. The output voltage, $V_{OUT}$, is:

$$V_{OUT} = V_{15}\left(\frac{R19}{R20} + 1\right)$$

where:

$V_{15}$ is the potential at node 15,

R19 is the value of resistor 19, and

R20 is the value of resistor 20.

In those production devices where $V_{15}$ is greater than 6.850, $V_{OUT}$ will usually have a positive tempco and when $V_{15}$ is below 6.850 $V_{OUT}$ will usually have a negative tempco. Thus, the circuit characteristics are dependent upon a production spread. It would be desirable to trim the circuit to provide a low controlled tempco and a particular output voltage. While the adjustment of resistor 20 permits selecting the output voltage at a particular temperature, the tempco can vary in a relatively uncontrolled manner.

DESCRIPTION OF THE INVENTION

Figure 2:
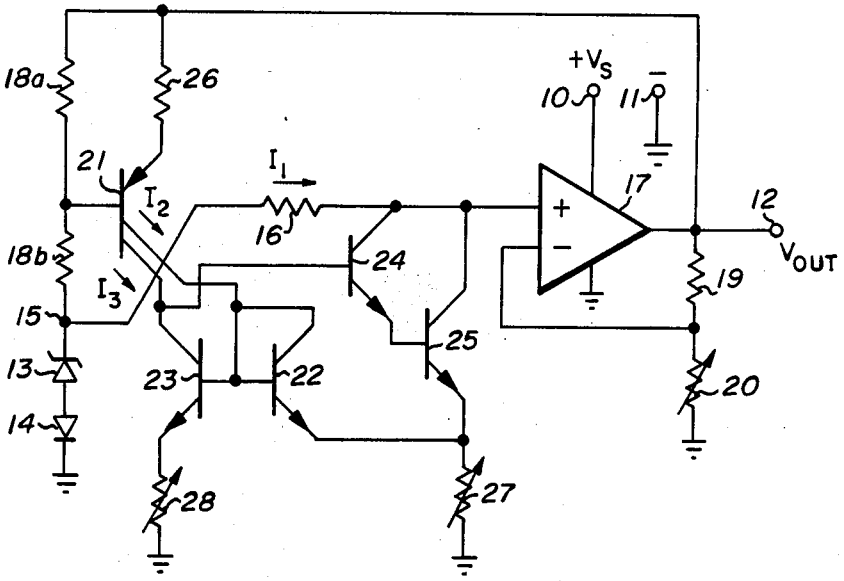
FIG. 2 is a schematic diagram of an adjustable voltage reference supply including a tempco trim.

FIG. 2 is a schematic diagram of a circuit that employs the invention. Where the elements perform in the same manner as those of FIG. 1 the same numerals are used. Diode 13 is selected to have a temperature drift of greater than that of diode 15 so that the potential at node 15 is somewhat greater than 6.850 volts. The additional circuit components act to pass $I_1$ through resistor 16. This creates a potential across resistor 16 that will oppose the potential at node 15.

Transistors 21–25 along with resistors 18*a*, 18*b* and 26–28 produce a current, $I_1$, that will flow in resistor 16 in the following manner. Transistor 21 is a dual collector PNP. Its base is returned to a tap on resistor 18 formed by splitting resistor 18 into two parts, 18*a* and 18*b*. It is to be understood that the potentials at node 15 and output terminal 12 are substantially constant and either low or zero tempco . Thus, the potential at the base of transistor 21 is constant and low tempco. However, the emitter of transistor 21 is returned to terminal 12 by way of resistor 26. Since the emitter-base potential of transistor 21 will have a tempco of about −2 mv/° C., the emitter potential of transistor 21 will have a negative tempco of close to −2 mv/° C. This will cause the potential across resistor 26 to have a tempco of close to +2 mv/° C. As a result, the currents flowing in the two collectors, $I_2$ and $I_3$, will each have a positive tempco. It can be seen that $I_2$ will flow in transistor 22 and resistor 27 and that $I_3$ will flow in transistor 23 and resistor 28. The base of transistor 22 is returned to its collector directly thereby forcing it to act as a diode. The circuit is completed by Darlington connected transistors 24 and 25 which act to couple the collector of transistor 23 back to its base by way of diode-connected transistor 22 thereby forcing transistor 23 to appear as a diode. If transistors 22 and 23 are matched and $I_2 = I_3$ (equal size collectors in transistor 21) the $V_{BE}$ values of transistors 22 and 23 will match. Thus, if resistors 27 and 28 are equal in value, no current will flow in transistors 24 and 25 so that the voltage drops across resistors 27 and 28 will match. If the value of resistor 28 is made larger than resistor 27, current will flow in transistors 24 and 25 so that the potentials across resistors 28 and 27 are equal. This current will represent an output current $I_1$. Thus, the circuit develops a current $I_1$ which can be adjusted by adjusting the value of either resistor 27 or resistor 28. This current will have a positive tempco because $I_2$ and $I_3$ do. In practice, resistor 28 would be adjusted until the potential at the noninverting input of Op Amp 17 is 6.850 volts. The added voltage drop across resistor 16, which opposes the potential at node 15, will have a positive tempco so that the positive tempco of the potential at node 15 will be offset.

Using the circuit of FIG. 2 which produces a −2 mv/° C. tempco at the emitter of transistor 21 produces a voltage across resistor 16 having a tempco of close to +1600 ppm/° C. This produces a voltage versus temperature curve slope that extra polates to zero at −100° K. While this represents an imaginary zero, the characteristic provides a temperature curve slope that can be used to correct the temperature curve slope of the potential at node 15. Thus, resistor 28 sets the circuit tempco.

Once resistor 28 has been adjusted to produce the desired potental at the noninverting input to Op Amp 17, the value of resistor 20 can be trimmed to obtain the desired output voltage at terminal 12.

Thus, the circuit of FIG. 2 will produce a temperature stable $V_{OUT}$. The magnitude and tempco of $V_{OUT}$ can be independently adjusted to any desired value above that of the node 15 level. It is to be understood that while the circuit shown produces a nearly PTAT potential across resistor 16 this is due to the biasing of transistor 21. As will be shown subsequently, if transistor 21 is provided with a constant bias, the current output can be made to have zero tempco.

Figure 3:
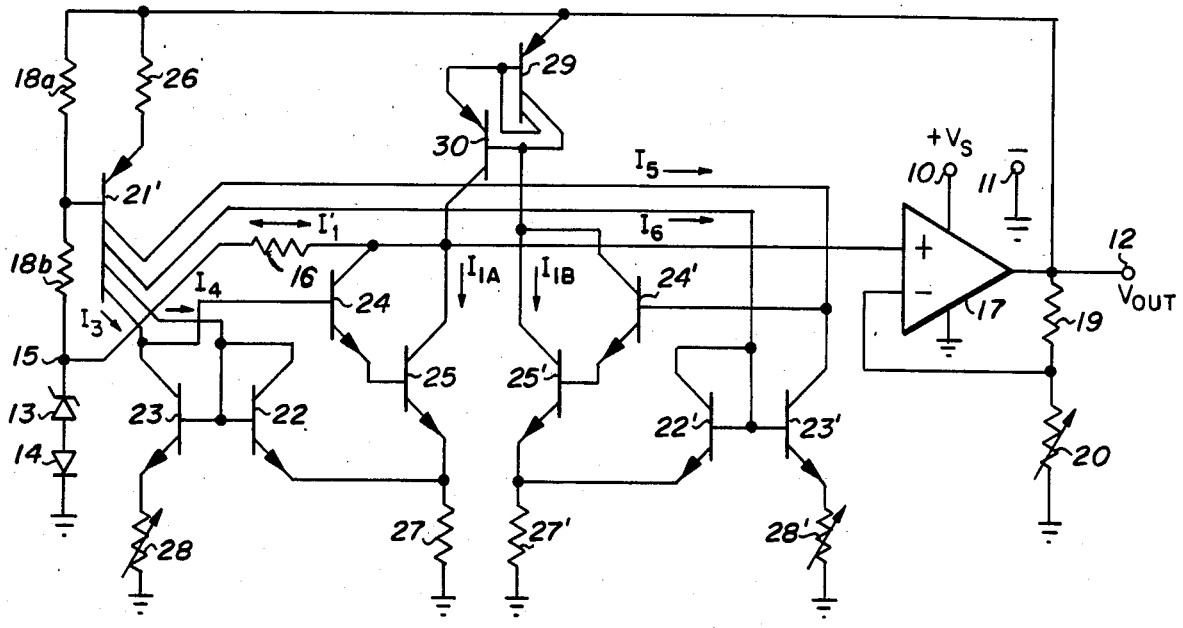
FIG. 3 is a schematic diagram of an adjustable voltage reference supply including a tempco trim that can accomodate either a positive or negative tempco.

FIG. 3 is a schematic diagram of a circuit in which a bidirectional correction current, $I'_1$, is produced. Where the parts function as do those in FIG. 2, the same numerals are employed. In this case, the tempco of the zener diode 13 is deliberately designed to match that of diode 14. Thus, the potential at node 15 is intended to be 6.850 volts. However, IC production tolerances are such that only a limited number of circuits will be sufficiently close to the desired value. For those devices $I'_1$ will desirably be zero. For those production devices that are not at the desired value, an adjustment of $I'_1$ for a + or − corrective value will be made. The correction will include a temperature-responsive term because any departure from the 6.850 volt level means that the tempco has shifted.

Transistor 21' has four collectors which feed two adjustment circuits of the kind shown in FIG. 2. Currents $I_3$ and $I_4$ feed a FIG. 2-type adjustment circuit which can act to sink current from resistor 16. Currents $I_5$ and $I_6$ feed a second similar adjustment circuit in which the various elements are identified with prime signs. The two adjustment circuits are coupled together with a well known Wilson-type current mirror made up of transistors 29 and 30. Transistor 29 is a dual collector PNP in which the collectors are matched and one is returned to the base so that a unity gain current reflection is present. Transistor 30, acting as a unity gain emitter follower, completes the feedback path of the other collector of transistor 29 to its base. Thus, whatever current, $I_{1B}$, is drawn in the right hand adjustment circuit (the one with the prime sign designations) will force transistor 30 to source the same current to resistor 16. If the two adjustment circuits have their respective resistors 27 and 27' set to the same value their currents are equal and $I'_1$ is zero. This means that there is no voltage drop across resistor 16 and the potential at node 15 will also be present at the noninverting input of Op Amp 17. If, however, the potential at node 15 is above or below the desired value, resistors 28 or 28' can be adjusted to correct the potential and any such correction includes a temperature sensitive component as explained for the FIG. 2 circuit. Also, as was the case for FIG. 2, after the current in resistor 16 is adjusted to produce a 6.850-volt reference level, the value of resistor 20 can be adjusted to establish the desired value of $V_{OUT}$ at terminal 12.

Figure 4:
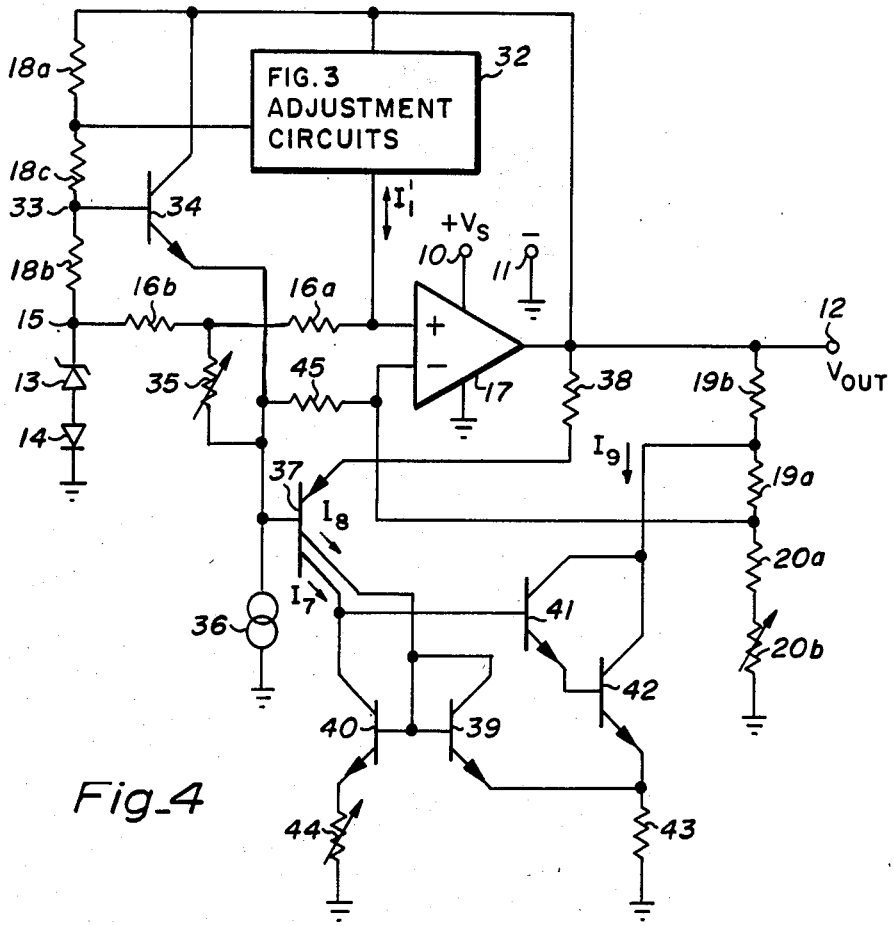
FIG. 4 is a schematic diagram of a trimmable voltage reference supply that includes independent tempco and voltage trims that can be employed at wafer probing and after assembly.

FIG. 4 is a schematic diagram of the preferred embodiment of the invention. Again, where similar part functions are involved, the FIGS. 2 and 3 designations are employed. Box 32 denotes the circuits of FIG. 3 employed to obtain the bidirectional $I'_1$. Resistor 18 is shown in three parts which are selected so that node 33 voltage is close to one $V_{BE}$ (about 650 mv) above node 15 at 300° K. Since the base of emitter follower transistor 34 is coupled to node 33 its emitter voltage is close to the level of node 15 at 300° K. Therefore, since the potential of node 33 will be substantially constant with a low tempco, the emitter of transistor 34 will have a tempco voltage drift of about +2 mv/° C.

Resistor 35 couples a portion of potential at the emitter of transistor 34 to the tap on resistor 16 which is formed by 16*a* and 16*b*. Thus, part of the emitter current in transistor 34 flows in resistor 16*b* back to node 15. Most of the remainder flows in current sink 36. Resistor 45 couples a relatively small part of the current to the inverting input of Op Amp 17. Thus, a bridge circuit is formed at the inputs of Op Amp 17. At 300° K. the potentials at node 15 and the emitter of transistor 34 balance and any adjustment of resistor 35 will not vary the differential input to Op Amp 17. However, at any other temperature the potentials no longer balance and varying resistor 35 change the tempco of the potential that is presented to the noninverting input of Op Amp 17. This is done without any change of the 25° C. voltage at the noninverting input of Op Amp 17 and consequently without any change of $V_{OUT}$ at terminal 12. This means that resistor 35 is a tempco trim element that does not appreciably alter the $V_{OUT}$ potential at terminal 12 at room temperature.

Since the base of transistor 37 is directly coupled to the emitter of transistor 34, its potential will also have a +2 mv/° C. tempco. The emitter-to-base potential of transistor 37 also has a −2 mv/° C. tempco so that the potential at the emitter of transistor 37 will have a zero or very low tempco. This in turn means that the voltage across resistor 38 is substantially constant with temperature. Thus, the current through resistor 38 and therefore the values of $I_7$ and $I_8$ will be constant and close to zero tempco.

Transistors 39–42 and resistors 43 and 44 function as do the similar components in FIG. 2. That is, the value of resistor 44 is made larger than resistor 43 and can be varied to control the current, $I_9$, that is pulled out of resistor 19*b*. Resistor 19*b* is made to be a small fraction of the value of resistor 19*a*. $I_9 \times$ the value of resistor 19*b* produces a voltage drop that adds to the drop across 19*a* to vary the potential at terminal 12. This means that altering the value of resistor 44 will vary the output voltage, but not the tempco.

Resistor 20*b* which is made small with respect to resistor 20*a* can be varied to provide an initial (coarse) temperature independent trim of the value of $V_{OUT}$ at terminal 12.

Figure 5A:
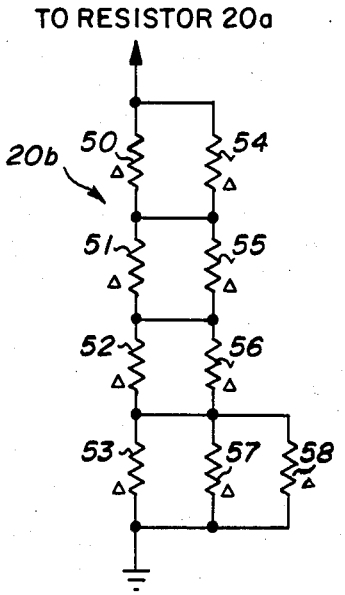
FIG. 5A shows the details of resistor 20*b.

FIG. 5A shows the details of resistor 20*b*. The resistor elements shown here as well as all of the other FIG. 5 illustrations makes use of thin film resistor elements that are deposited on top of the IC passivating oxide. Any one of a combination of triangle marked resistors 50 through 58 can be severed by a laser beam so as to remove them from the circuit. It is to to be understood that while any of the triangle marked resistors can be severed only one of any parallel combination can be severed. Thus, either resistor 50 or 54 could be severed, but not both. This leaves any desired combination of resistors 50–58 to provide a plurality of resistance steps between two resistance extremes that can be invoked at wafer probing in response to laser trimming.

Figure 5B:
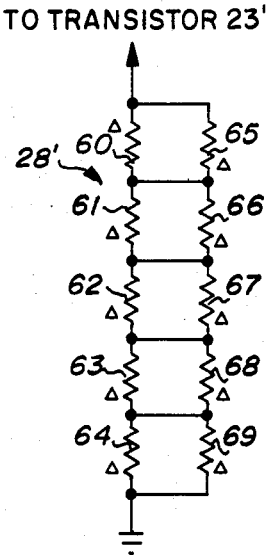
* FIG. 5B shows the details of resistor 28'.

FIG. 5B shows the details of resistor 28' (of FIG. 3). Here any one or combination of resistors 60–69 can be removed by laser trimming. The values of resistors 60–69 are selected for the desired resistance steps. Again, only one of the parallel combinations can be severed, not both.

Figure 5C:
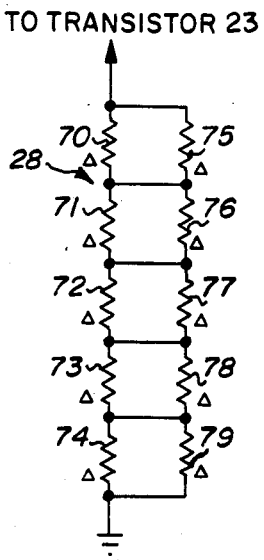
FIG. 5C shows the details of resistor 28.

FIG. 5C shows the details of resistor 28 (of FIG. 3). As in FIG. 5B any one or combination of resistors 70–79 can be removed by laser trimming. Again, only one element of a parallel combination can be severed. The values of resistors 70–79 are selected for the desired resistance steps.

Figure 5D:
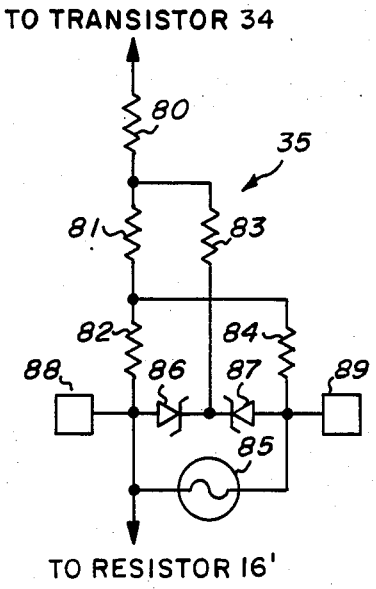
FIG. 5D shows the details of resistor 35.

FIG. 5D shows the details of resistor 35. This resistor can be varied or trimmed either at wafer probing or after IC assembly. Resistors 80–84 in combination with fuse 85 and zener diodes 86 and 87 form a five-way trim network as taught in above-referenced U.S. Pat. No. 4,412,241. The resistance value can be adjusted by the application of trimming current pulses to pads 88 and 89. The network has an original resistance value. Then, depending upon the pulse polarity and magnitude, the resistance can be either increased one or two steps or decreased by one or two steps. This provides five selected resistance values. In the example to be given the selected values have equal resistance steps.

Figure 5E:
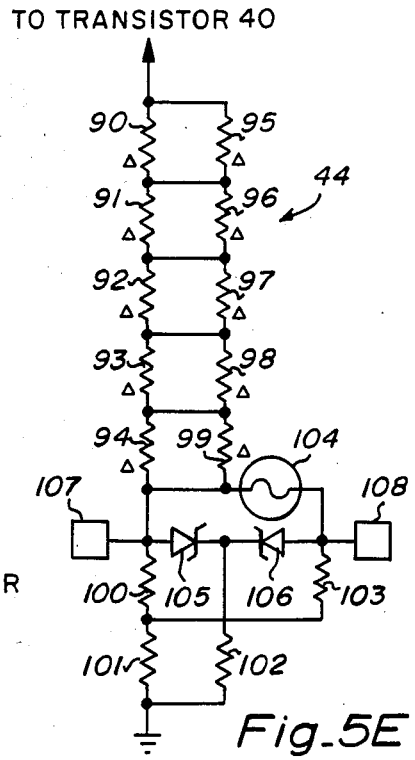
FIG. 5E shows the details of resistor 44.

FIG. 5E shows the details of resistor 44. Here the five-way trim circuit is combined with a laser trimmable resistance network. Any one or combination of resistors 90–99 can be laser trimmed to leave any combination of resistors 90–99 which are selected in value to provide the desired resistance increments. Resistors 100–103 in combination with fuse 104 and zener diodes 105–106 form a five-way trim by means of pulses applied to bonding pads 107 and 108. Thus, resistor 44 is first trimmed at wafer probing by means of a laser to provide a medium circuit adjustment. Then, after chip assembly, the five-way trim is invoked to provide a final fine trim.

The overall trim sequence is as follows. At wafer probing, the potential at the noninverting input of Op Amp 17 is monitored. If its value is at 6.850 volts, circuit 32 is left alone. If the voltage is below 6.850 volts, resistor 28' is laser trimmed to increase its value and therefore $I_{1B}$ so as to raise the voltage to close to 6.850. If the voltage is too high resistor 28 is laser trimmed so as to raise $I_{1A}$ and, therefore, lower the voltage to close to 6.850. The laser trimming is based upon the magnitude of the voltage error so that the trimming required is known in advance and the proper resistors are severed to produce the desired correction. Since the circuit includes two adjustments one can first be trimmed to over compensate and the second one trimmed to correct for the overshoot. The two circuits in combination permit a high degree of precision in achieving the desired 6.850 volts.

Then resistor **20*b* is laser trimmed to establish the desired output voltage at terminal 12. This is a coarse adjustment that actually produces a slightly below rating output voltage. Then resistor 44** is laser trimmed to raise the output voltage to close to the desired level. At this point the circuit at wafer probe is very close to the desired voltage level.

During IC chip assembly, bonding pads 88, 89, 107 and 108 of resistors 35 and 44 are attached to package pins, as well as points 10, 12 and ground. After the chip has been assembled into a package, resistor 44 can be finally adjusted to provide an output very close to the design value by the above-described fuse blowing and zener zapping of U.S. Pat. No. 4,412,241. Then, if desired, resistor 35 can have its value either raised or lowered as needed to provide the correct tempco without appreciably varying the room-temperature voltage level.

EXAMPLE

The circuit of FIGS. 3, 4 and 5 was constructed using PN-junction-isolated monolithic silicon IC design. The following part values were employed.

| COMPONENT | VALUE |
|---|---|
| Resistor 16a | 3.25K ohms |
| Resistor 16b | 750 ohms |
| Resistor 18a | 3.8K ohms |
| Resistor 18b | 1.28K ohms |
| Resistor 18c | 844 ohms |
| Resistor 19a | 10K ohms |
| Resistor 19b | 400 ohms |
| Resistor 20a | 19.13K ohms |
| Resistor 20b | 2.09–4.17K ohms (see note 1) |
| Resistor 26 | 30K ohms |
| Resistor 27 and 27' | 4K ohms |
| Resistor 28 | 5–43K ohms (see note 2) |
| Resistor 28' | 5–35K ohms (see note 3) |
| Resistor 35 | 10K ± 1K ± 2K (see note 4) |
| Current Sink 36 | 100 microamperes |
| Resistor 38 | 40K ohms |
| Resistor 43 | 4K ohms |
| Resistor 44 | 5–35K ohms (see note 5) |
| Resistor 45 | 95K ohms |
| (Note 1) Resistor 20b is made up of | |
| Resistor 50 | 1.5K ohms |
| Resistors 51 and 55 | 1K ohms |
| Resistor 52 | 1.04K ohms |
| Resistor 53 | 666 ohms |
| Resistor 54 | 750 ohms |
| Resistor 56 | 2.875K ohms |
| Resistor 57 | 1.25K ohms |
| Resistor 58 | 2.125K ohms |
| (Note 2) Resistor 28 is made up of | |
| Resistor 70 | 2K ohms |
| Resistor 71 | 1.6K ohms |
| Resistor 72–74 | 1K ohms |
| Resistor 75 | 6.53K ohms |
| Resistor 76 | 3.1K ohms |
| Resistor 77 | 1.875K ohms |
| Resistor 78 | 10.9K ohms |
| Resistor 79 | 20.95K ohms |
| (Note 3) Resistor 28' is made up of | |
| Resistors 60–63 | 1K ohms |
| Resistor 64 | 2K ohms |
| Resistor 65 | 4.622K ohms |
| Resistor 66 | 2.732K ohms |
| Resistor 67 | 1.875K ohms |

-continued

| COMPONENT | VALUE |
|---|---|
| Resistor 68 | 8.39K ohms |
| Resistor 69 | 16.79K ohms |
| (Note 4) Resistor 35 is made up of | |
| Resistor 80 | 2.6K ohms |
| Resistors 81 | 5.4K ohms |
| Resistors 82 and 84 | 4K ohms |
| Resistor 83 | 20K ohms |
| (Note 5) Resistor 44 is made up of | |
| Resistor 90–94 | 1K ohms |
| Resistor 95 | 4.625K ohms |
| Resistor 96 | 2.7324K ohms |
| Resistor 97 | 1.875K ohms |
| Resistor 98 | 8.39K ohms |
| Resistor 99 | 15.94K ohms |
| Resistors 100 and 103 | 4K ohms |
| Resistor 101 | 5.4K ohms |
| Resistor 102 | 20K ohms |

In notes 1 through 5 the resistor values are given in two, three and four places. As a practical matter the values can be rounded off to a lower tolerance as desired. The circuits were operated from a 14-volts supply and were adjusted to provide a 10-volt output. It was found that at wafer sorting the voltage regulator output voltage could be trimmed to within ±0.02% of 10 volts. The tolerance after assembly was to within ±0.03% and within 0.01% after the post-assembly trim. The after-assembly tempco was less than 5 PPM° C. before trim and less than 1.5 PPM/° C. after post-assembly tempco trim.

The invention has been described and a working example detailed. When a person skilled in the art read the foregoing description, alternatives and equivalents, within the spirit and intent of the invention, will be apparent. Accordingly, it is intended that the scope of the invention be limited only by the claims that follow.

I claim:

1. A trimming circuit for developing an output current that is related to the value of trimmable resistor means, said circuit comprising:

first transistor means having a base and collector connected together so that said first transistor is diode connected and an emitter coupled in series with a first resistor;

a first current supply coupled to pass a first current through said first transistor and first resistor;

second transistor means having a base coupled to said base of said first transistor means, a second resistor coupled in series with its emitter, and a second current supply coupled to its collector to pass a second current through said second transistor and said second resistor; and third transistor means having a base coupled to said collector of said second transistor means, an emitter coupled to said emitter of said first transistor means and a collector coupled to conduct said output current whereby said output current has a value determined by the values of said first and second resistors which can be trimmed to establish the magnitude of said output current.

2. The circuit of claim 1 wherein said second resistor is larger in value that said first resistor.

3. The circuit of claim 1 wherein said third transistor means comprise a Darlington-connected pair of transistors.

4. The circuit of claim 1 further including means to vary said first resistor wherein said output current is an inverse function of the value of said first resistor.

5. The circuit of claim 1 further including means to vary said second resistor wherein said output current is a direct function of the value of said second resistor.

6. The circuit of claim 1 further including means to vary both said first and said second resistor values.

7. The circuit of claim 1 further including means to make said first and second current supplies proportional to absolute temperature whereby said output current varies with temperature.

8. The circuit of claim 7 wherein said output current is proportional to absolute temperature plus a constant.

9. The circuit of claim 1 wherein said third transistor means acts as an output current sink.

10. The circuit of claim 9 further comprising a current mirror which has a current source output combined with said current sink output whereby said output current can be made to flow in either direction.

11. A voltage regulator circuit comprising:

an operational amplifier having an output at which a regulated voltage appears, an inverting input and a noninverting input;

a voltage divider coupled across said output and having a tap coupled to said inverting input of said operational amplifier;

a source of reference potential having a zero temperature coefficient at a desired potential level, a negative temperature coefficient at a lower potential level, and a positive temperature coefficient at a higher potential level, said source of reference potential operating to develop a potential that is a function of the manufacturing process and is therefore indeterminate;

a first series resistor coupled between said source of reference potential and said noninverting input of said operational amplifier; and a first trimming means for passing a first adjustable current through said first series resistor to develop a voltage drop thereacross which, when combined with said reference potential, produces said desired potential level.

12. The circuit of claim 11 wherein said first trimming means further includes means for developing a first current in said series resistor that can flow in either direction.

13. The circuit of claim 12 wherein said first current has a predetermined positive temperature coefficient.

14. The circuit of claim 13 wherein said first current is proportional to absolute temperature.

15. The circuit of claim 11 wherein said voltage divider includes a second series resistor coupled in series therewith and second trimming means for passing a second adjustable current through said second series resistor to develop a voltage thereacross which when combined with the potentials developed across said voltage divider elements produces a desired regulated output voltage level.

16. The circuit of claim 15 further including means for producing a low temperature coefficient for said second adjustable current.

17. The circuit of claim 15 further including means for changing the temperature coefficient of said regulated output voltage comprising:

a temperature responsive voltage source which produces a potential that varies as a function of temperature and is substantially equal to said source of reference potential at about 25° C.;

a third variable resistor coupled between said temperature responsive voltage source and said noninverting input of said operational amplifier; and a fourth resistor coupled between said temperature responsive voltage source and said inverting input of said operational amplifier whereby the signal voltage gain of the circuit from said temperature responsive voltage source to the output of said operational amplifier is substantially zero at 25° C. and varying the value of said third variable resistor will not vary said regulated output voltage at 25° C.

* * * * *